US006932659B1

(12) United States Patent
Wong

(10) Patent No.: US 6,932,659 B1
(45) Date of Patent: Aug. 23, 2005

(54) TERMINAL WITH CARD EDGE LOCKING PROVISIONS

(75) Inventor: Richard P. Wong, Troy, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/757,916

(22) Filed: Jan. 14, 2004

(51) Int. Cl.[7] ..... H01R 11/22
(52) U.S. Cl. ..... 439/853; 439/59; 439/352; 439/357
(58) Field of Search ..... 439/850–853, 439/857, 856, 59, 61, 62, 352–353, 357–358, 439/848, 849

(56) References Cited

U.S. PATENT DOCUMENTS 3,729,701 A * 4/1973 Smith ..... 439/858
4,299,436 A 11/1981 Ackerman
4,401,356 A * 8/1983 Bare ..... 439/329
4,752,254 A * 6/1988 Inoue et al. ..... 439/834
4,945,192 A * 7/1990 Urushibata et al. ..... 174/94 R
5,238,411 A * 8/1993 Jinno et al. ..... 439/59
5,306,158 A * 4/1994 Endo et al. ..... 439/59
5,639,270 A * 6/1997 Barbieri et al. ..... 439/849
5,722,925 A 3/1998 Kameyama et al.

FOREIGN PATENT DOCUMENTS

JP 08-255643 10/1996
JP 10-092527 4/1998

* cited by examiner

*Primary Examiner*—Hien Vu
*Assistant Examiner*—X. Chung-Trans
(74) *Attorney, Agent, or Firm*—Young & Basile, P.C.

(57) ABSTRACT

A card edge terminal box-like configuration made from bending a stamped blank into the desired form. A pair of longer, lower spaced apart arms engage a trace side of a circuitboard while a pair of shorter upper arms having detents formed on the distal or free ends thereof engage an opposite surface of the circuitboard and have detent portions which snap into a slot which is strategically located in the non-trace surface of the circuitboard. A spring contact between the arms is resiliently deflected from a first raised position to a second lowered position as it engages the edge trace on the circuitboard. Stable mechanical and electrical association between the terminal and the circuitboard is assured over a wide variety of harsh operating environmental conditions.

7 Claims, 2 Drawing Sheets

FIG - 4
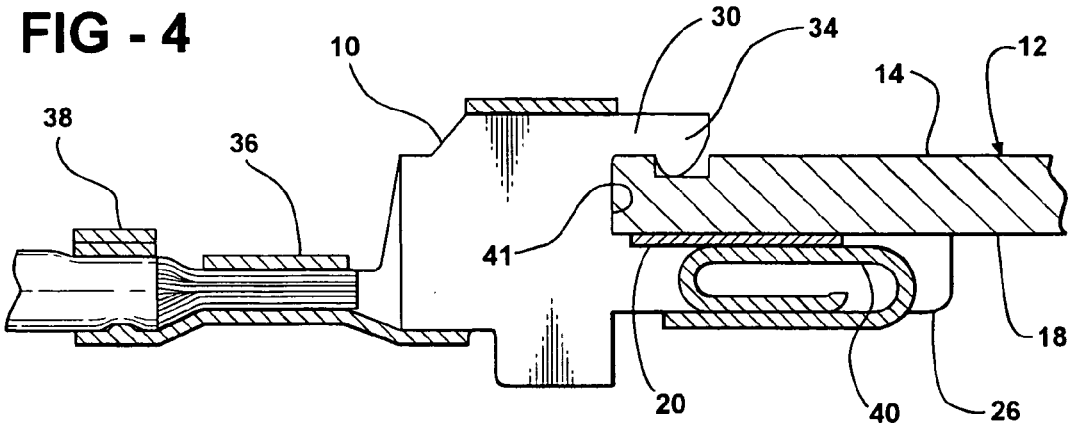
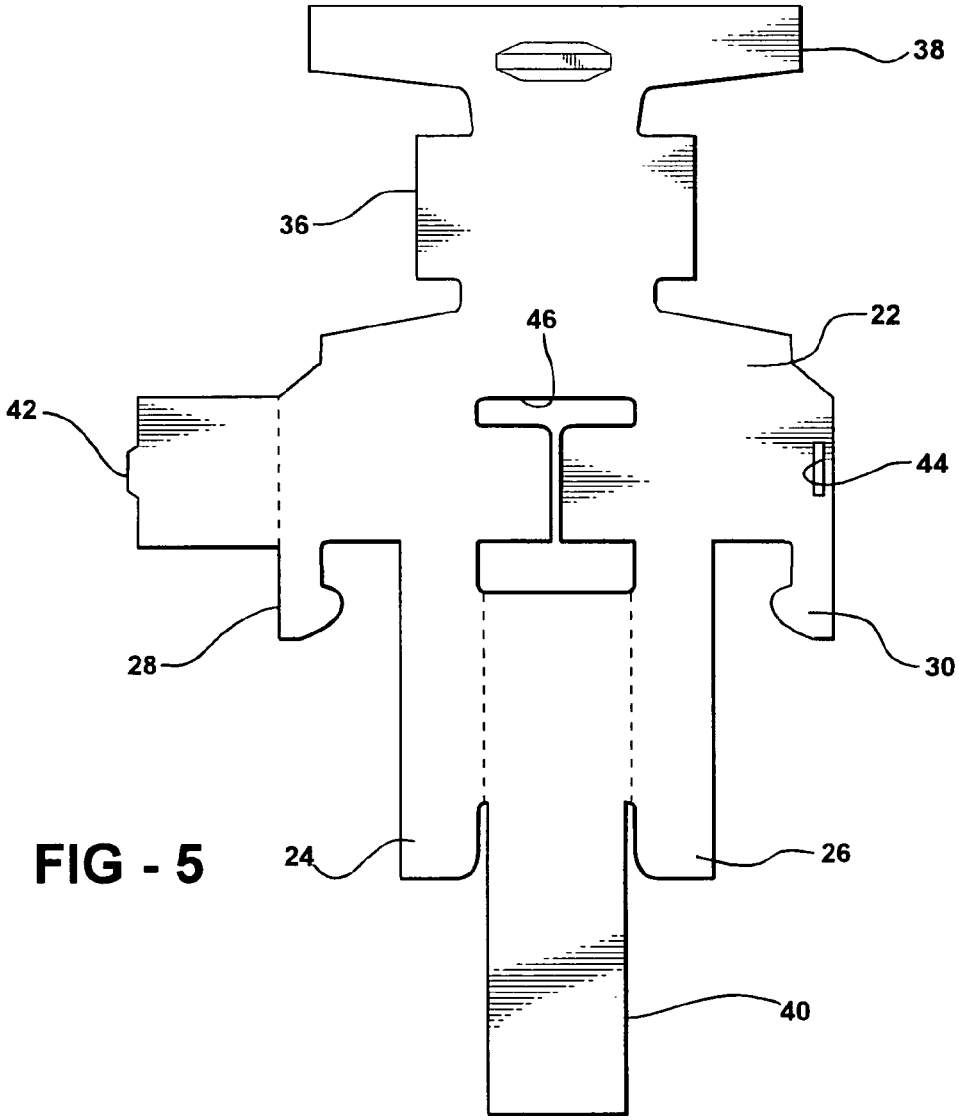
FIG - 5

TERMINAL WITH CARD EDGE LOCKING PROVISIONS

FIELD OF THE INVENTION

This invention relates to electrical terminals and more particularly to a self-stabilizing terminal designed to receive a circuitboard having a conductive trace on at least one of two opposite surfaces thereof.

BACKGROUND OF THE INVENTION

A co-pending application for U.S. patent, Ser. No. 10/624,073, filed Jul. 21, 2003, discloses an electrical terminal in which spring contacts held in a carrier body are brought into engagement with conductive pads on one or more surfaces of a circuitboard proximate an edge thereof. The terminals disclosed in the above-identified application are box-like metal bodies formed by strategically bending a stamping so as to exhibit a spring contact which is extended axially outward and is curved or folded back to provide a resilient member which slidingly engages an edge trace on the circuitboard. The carrier body positions the contact member so that it is brought into resilient engagement with the trace on the circuitboard as the board is inserted into the body.

Another co-pending application Ser. No. 10/639,307, filed Aug. 12, 2003, discloses a conductive spring-type terminal for connecting a wire or cable to an edge trace on a circuitboard by gripping or trapping the circuitboard between opposing contact elements. The terminal body exhibits a main spring contact on one side of the body and, in opposing relationship to the main contact, a pair of stabilizing contacts which are spread apart so as to effectively straddle the projected area of the main contact thereby to improve the stability of the electrical contact and help to prevent intermittent contact which sometimes occurs with prior art devices.

The terminals described above are preferably made from conductive metal stampings which, after the stamping operation, are bent and mechanically locked into the desired box-like shape.

SUMMARY OF THE INVENTION

The present invention provides an improved card edge terminal for making electrical contact with a circuitboard having an edge trace on at least one side and which provides an essentially consistent contact force even though the terminal may be exposed to harsh environmental conditions such as thermal shock, vibration, and other such conditions which tend to cause a variation in contact force and/or destabilize the terminal from the circuitboard to which it is mechanically and electrically connected.

In general, the objectives of the present invention are achieved by providing an integral box-like body of conductive material having a first pair of laterally spaced arms for engaging a trace surface of a circuitboard, a second pair of laterally spaced arms to engage a second circuitboard surface opposite said trace surface, the first and second pairs of arms being spaced apart to define a circuitboard receiving volume therebetween, and a spring contact extending from at least one of the arms of the first pair toward the second pair of arms and into said receiving volume to engage a trace on said trace surface when the circuitboard is inserted into the volume.

In the preferred form, the first pair of arms are substantially shorter than the second pair of arms, extend parallel thereto in overlying relationship and are provided with detent portions on the distal or free ends thereof to flex and drop into a slot near the edge of the circuitboard and in the non-trace surface thereof to mechanically snap lock the terminal to a circuitboard and provide mechanical stability in the mechanical/electrical engagement therebetween.

Other applications of the present invention will become apparent to those skilled in the art when the following description of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 4 is a side view in section of the combination of FIG. 3; and

FIG. 5 is a plan view of a metal stamping from which the box-like terminal of FIGS. 1–3 may be formed.

DETAILED DESCRIPTION OF THE ILLUSTRATIVE EMBODIMENT

Figure 1:
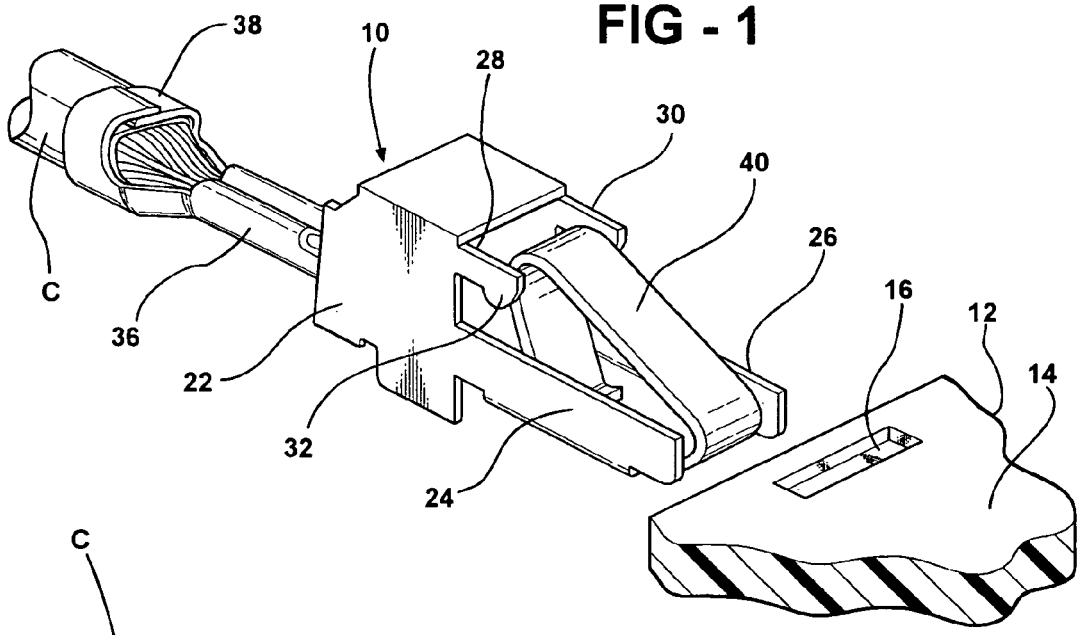
FIG. 1 is a perspective view of a terminal constructed in accordance with the present invention prior to engagement with a circuitboard designed to mate with such terminal.

Referring to FIGS. 1–4, there is shown a box-like metal terminal 10 in combination with a circuitboard 12 of the type having opposed parallel flat surfaces 14 and 18. A slot 16 is formed near the edge of the surface 14 and an edge trace 20 is deposited on the opposite surface 18 near the edge of the circuitboard 12.

Figure 3:
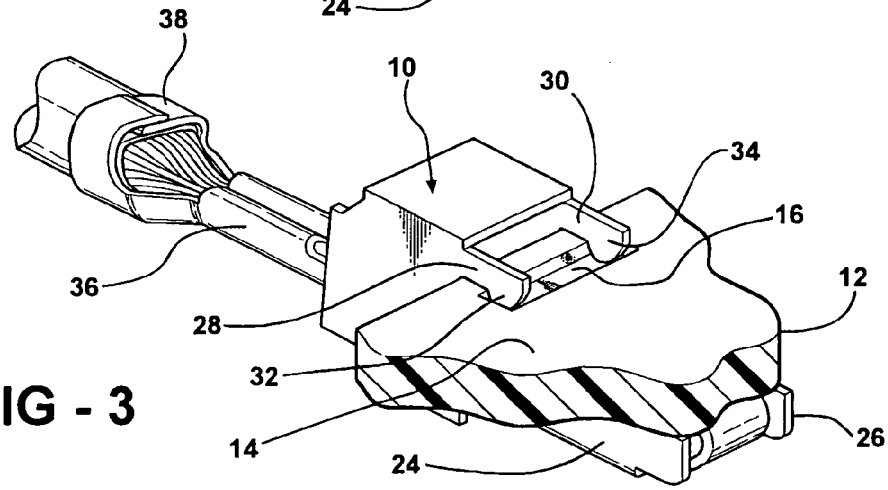
FIG. 3 is a perspective view of the combination of FIGS. 1 and 2 with the circuitboard fully inserted into engagement with the terminal.

The box-like terminal 10 comprises a stamped and folded box-like body 22 defining a first pair of laterally spaced apart arms 24 and 26 and a second upper pair of spaced apart arms 28 and 30. The lower arms 24 and 26 are laterally spaced apart by approximately the same lateral spacing as the distance between the upper arms 28 and 30 such that the upper arms essentially overlie the lower arms but are spaced therefrom a sufficient distance to define a volume which is adapted to receive the circuitboard 12 as shown in FIGS. 3 and 4. The lower arms 24 and 26 are longer than the upper arms 28 and 30. Between the arms 24 and 26 and integral therewith over the bottom extension thereof is a spring contact 40 which is folded back on itself to extend upwardly toward and to a position between the upper arms 28 and 30 so as to substantially span the entire circuitboard receiving volume between the upper and lower pairs of arms when undeflected.

Figure 2:
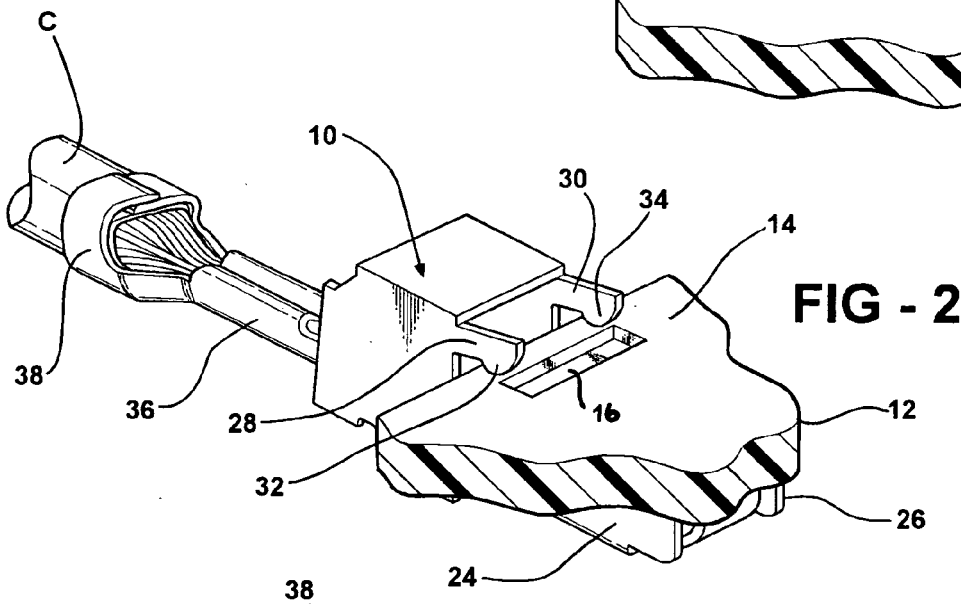
FIG. 2 is a perspective view of the combination of FIG. 1 with the circuitboard partially inserted into the box-like terminal.

In addition to the details described above, the upper arms 28 and 30 are provided at the distal or free ends thereof with lobe-like detents 32 and 34 which extend or depend downwardly toward the lower arms 24 and 26 so as to fit into the slot 16 in the circuitboard 12 when the circuitboard is fully inserted into the circuitboard receiving volume between the upper and lower pairs of arms as shown in FIGS. 3 and 4. The material from which the box-like body and all of the integral portions thereof is made is sufficiently flexible to permit the upper arms 28 and 30 to flex upwardly or outwardly away from the lower arms to permit insertion of the circuitboard in a resilient spring-like fashion as shown in FIG. 2.

In addition, the terminal 10 is provided with a first pair of tabs 36 which can be bent upwardly into gripping engagement with the stripped strands of a multi-wire conductor C as shown in each of FIGS. 1–4 to provide electrical continuity from the conductor C to the terminal 10. A second pair of tabs 38 can be folded onto one another to grip the insulated portion of the conductor C to maintain the mechanical engagement between the conductor C and the terminal 10.

As stated above, when the circuitboard 12 is inserted into the volume between the lower arms 24 and 26 and the upper arms 28 and 30, spring contact 40 is flexed downwardly toward the lower arms 24 and 26. As the circuitboard 12 reaches the detents 32 and 34, the upper arms 28 and 30 flex upwardly until they snap into the slot 16 to mechanically grip and engage the circuitboard and maintain substantially constant tension in the spring contact 40 regardless of the environment in which the combination shown in the figures is used. When the spring contact 40 is fully downwardly deflected as shown in FIG. 4, it is in full contact with the edge trace 20 to provide the desired electrical circuit. The circuitboard need not fit all the way into the volume so as to engage surfaces 41 as shown in FIG. 4; however, this is the preferred mechanical arrangement for purposes of maintaining stability of the combination.

The terminal 10 is preferably made of a stampable metal such as tin-plated brass or copper alloy. The various components of the finished terminal 10 are indicated in FIG. 5 when the terminal stamping is in the unfolded condition, the fold lines being represented by dashed lines in the drawing. A central lower aperture 46 is provided as shown along with a locking tab 42 and slot 44 to hold the terminal in the box-like folded condition after it is fully formed. The specific shape shown in FIG. 5 is for illustration purposes only as many variations and configurations are possible while still achieving the objectives and advantages of the device illustrated and described above. The spring forces in a practical embodiment will be anywhere between approximately five to twelve Newtons, again by way of example. The circuitboard is typically a composite or laminated printed circuitboard with traces on one side only but may have traces on both sides in a particular embodiment.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A terminal for making electrical contact with a circuitboard having a slot and edge trace comprising:

a box-shaped conductive body having a first pair of laterally spaced arms to engage a trace surface of a circuitboard;

a second pair of laterally spaced arms to engage a second circuitboard surface opposite said trace surface, at least one of said second pair of arms having a detent portion integrally depending from a distal end thereof toward an arm of said first pair, such that the detent fits into said slot;

said pair of first arms being spaced apart from said second pair of arms to define a circuitboard receiving volume; and a spring contact extending from at least one of the first pair of arms toward the second pair of arms and into said volume to engage said trace surface when a circuitboard is inserted into said volume between the first and second pairs of arms, wherein the body further includes integral means for receiving, gripping and making electrical contact with a wire conductor.

2. A terminal as defined in claim 1 wherein the arms of said second pair substantially directly overlie the arms of said first pair.

3. A terminal as defined in claim 1 wherein the conductive body is made of a material sufficiently flexible to permit the second pair of arms to flex away from the first pair of arms when a circuitboard is inserted into the volume.

4. A terminal as defined in claim 1 wherein the first pair of arms is longer than the second pair of arms.

5. A terminal as defined in claim 1 wherein the detent portion is lobe-shaped.

6. In combination:

a circuitboard having opposite planar surfaces, one of which carries a trace and the other of which has a slot formed therein; and a terminal for making electrical contact with an edge trace on said circuitboard, said terminal comprising:

a box-shaped conductive body having a first pair of laterally spaced arms to engage a trace surface of a circuitboard;

a second pair of laterally spaced arms to engage a second circuitboard surface opposite said trace surface, at least one of said second pair of arms having a detent portion integrally depending from a distal end thereof toward an arm of said first pair such that the detent fits into said slot;

said pair of first arms being spaced apart from said second pair of arms to define a circuitboard receiving volume; and a spring contact extending from at least one of the first pair of arms toward the second pair of arms and into said volume to engage said trace surface when a circuitboard is inserted into said volume between the first and second pairs of arms wherein the body further includes integral means for receiving, gripping and making electrical contact with a wire conductor.

7. The combination as defined in claim 6 wherein the arms of said second pair substantially directly overlie the arms of said first pair.

* * * * *